US012503809B2

(12) United States Patent
Cho et al.

(10) Patent No.: US 12,503,809 B2
(45) Date of Patent: Dec. 23, 2025

(54) WASHING MACHINE AND CLOTHES TREATING APPARATUS

(71) Applicant: SAMSUNG ELECTRONICS CO., LTD., Suwon-si (KR)

(72) Inventors: Youngjin Cho, Suwon-si (KR); Jaeryong Park, Suwon-si (KR); Kanghyun Lee, Suwon-si (KR); Dongpil Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 234 days.

(21) Appl. No.: 17/960,552

(22) Filed: Oct. 5, 2022

(65) Prior Publication Data

US 2023/0212809 A1 Jul. 6, 2023

Related U.S. Application Data

(63) Continuation of application No. PCT/KR2022/014079, filed on Sep. 21, 2022.

(30) Foreign Application Priority Data

Jan. 3, 2022 (KR) ..... 10-2022-0000242

(51) Int. Cl.
*D06F 39/10* (2006.01)
*D06F 23/02* (2006.01)
*D06F 39/08* (2006.01)

(52) U.S. Cl.
CPC ..... *D06F 39/10* (2013.01); *D06F 23/02* (2013.01); *D06F 39/085* (2013.01)

(58) Field of Classification Search
CPC ..... D06F 39/10; D06F 23/02; D06F 39/085
(Continued)

(56) References Cited

U.S. PATENT DOCUMENTS 8,733,376 B2 5/2014 Tuller et al.
11,932,983 B2 3/2024 Kim et al.
(Continued)

FOREIGN PATENT DOCUMENTS

CN 206034121 U 3/2014
CN 204185692 U 3/2015
(Continued)

OTHER PUBLICATIONS

JP2009089947A—machine translation (Year: 2009).*
(Continued)

*Primary Examiner* — Tinsae B Ayalew
(74) *Attorney, Agent, or Firm* — STAAS & HALSEY LLP

(57) ABSTRACT

A washing machine includes a cabinet, a tub arranged inside the cabinet, and a washing water treatment apparatus connectable to the tub and configured to circulate water introduced in the tub and discharge the water to an outside of the cabinet. The washing water treatment apparatus includes a case forming an exterior of the washing water treatment apparatus, a filter mountable on an inside of the case and detachable from the inside of the case, a filter blade rotatable inside the filter, a filter driving source to generate power to rotate the filter blade, a drive gear configured to receive the power from the filter driving source and rotate along a first rotation axis, and a filter gear configured to rotate along a second rotation axis at a predetermined angle with respect to the first rotation axis and rotate the filter blade according to a rotation of the drive gear.

16 Claims, 12 Drawing Sheets

(58) Field of Classification Search
USPC ..... 134/110
See application file for complete search history.

(56) References Cited

U.S. PATENT DOCUMENTS

| | | | | |
|---|---|---|---|---|
| 2009/0071912 | A1 | 3/2009 | Mishina et al. | |
| 2017/0233937 | A1* | 8/2017 | Kim | D06F 39/10 68/207 |
| 2020/0149209 | A1 | 5/2020 | Nakashima et al. | |
| 2020/0399816 | A1 | 12/2020 | Zhao et al. | |

FOREIGN PATENT DOCUMENTS

| | | | |
|---|---|---|---|
| CN | 105506914 | A * | 4/2016 |
| CN | 108729148 | | 11/2018 |
| CN | 213206959 | U | 5/2021 |
| JP | 2007-105496 | | 4/2007 |
| JP | 2007-130380 | | 5/2007 |
| JP | 2009-89947 | | 4/2009 |
| KR | 20-1994-0008435 | | 12/1994 |
| KR | 2003-0080733 | | 10/2003 |
| KR | 10-1645040 | | 8/2016 |
| KR | 10-2021-0075449 | | 6/2021 |
| KR | 10-2022-0103280 | | 7/2022 |

OTHER PUBLICATIONS

CN213206959U—machine translation (Year: 2021).*
CN105506914A—machine translation (Year: 2016).*
International Search Report dated Jan. 18, 2023 in International Patent Application No. PCT/KR2022/014079 (3 pages; 3 pages English translation).
PCT/ISA/237 dated Jan. 18, 2023 in International Patent Application No. PCT/KR2022/014079 (4 pages).
European Search Report issued on Sep. 30, 2024 for European Patent Application No. 22916298.7.
European Office Action dated Jul. 4, 2025 for European Application No. 22916298.7.

* cited by examiner

WASHING MACHINE AND CLOTHES TREATING APPARATUS

CROSS-REFERENCE TO RELATED APPLICATION(S)

This application is a continuation application, under 35 U.S.C. § 111(a), of International Application No. PCT/KR2022/014079, filed on Sep. 21, 2022, which claims priority to Korean Patent Application No. 10-2022-0000242, filed on Jan. 3, 2022, in the Korean Intellectual Property Office, the disclosure of which is incorporated by reference herein in its entirety.

BACKGROUND

1. Field

The disclosure relates to a washing machine and a clothes treating apparatus and more particularly to a washing machine and a clothes treating apparatus including a filter.

2. Description of Related Art

A washing machine is a household appliance that washes clothes, towels, and bedding. The washing machine may be classified into a drum type washing machine that washes laundry by repeating rising and falling of the laundry by rotating a drum, and a pulsator type washing machine that washes laundry using a water flow generated by a pulsator when a drum rotates.

A cycle performed by the washing machine may include wash, rinse, and spin-dry cycles regardless of the type of washing machine. The wash cycle supplies detergent water to a tub in which laundry is stored, and washes the laundry while rotating a drum. The rinse cycle supplies rinsing water to the tub and rinses the laundry by rotating the drum. The spin-dry cycle discharges water from the tub and removes water from the laundry by rotating the drum.

The washing machine may include a circulation flow path for circulating washing water when performing the wash cycle and/or the rinse cycle. The washing machine may include a drain flow path for draining washing water when performing the wash cycle, the rinse cycle, and/or the spin-dry cycle.

SUMMARY

In accordance with an aspect of the disclosure, a washing machine includes a cabinet, a tub arranged inside the cabinet, and a washing water treatment apparatus connectable to the tub and configured to circulate water introduced in the tub and discharge the water to an outside of the cabinet. The washing water treatment apparatus includes a case forming an exterior of the washing water treatment apparatus, a filter mountable on an inside of the case and detachable from the inside of the case, a filter blade rotatable inside the filter, a filter driving source to generate power to rotate the filter blade, a drive gear configured to receive the power from the filter driving source and rotate along a first rotation axis, and a filter gear configured to rotate along a second rotation axis at a predetermined angle with respect to the first rotation axis and rotate the filter blade according to a rotation of the drive gear.

The case may include an inlet through which the water of the tub is introduced to the case. The washing water treatment apparatus may include a circulation pump configured to circulate the water, which flows from the inlet, to the tub, and a drain pump configured to discharge the water, which flows from the inlet and through the tub, to the outside of the cabinet.

A rotation axis of a drain motor of the drain pump may be different from a rotation axis of a circulation motor of the circulation pump.

A rotation axis of the drive gear may be different from the rotation axis of the drain motor.

A rotation axis of the filter gear may be the same as the rotation axis of the drain motor.

The filter may be arranged between the circulation pump and the drain pump.

The filter driving source may be arranged at a position closer to the drain pump than to the circulation pump.

The case may include a circulation opening arranged adjacent to the circulation pump to guide the water that is circulated to the tub by the circulation pump, and a drain opening arranged adjacent to the drain pump to guide the water that is discharged to the outside of the cabinet by the drain pump.

The filter driving source may be arranged adjacent to the drain opening.

The filter is a first filter to filter the water introduced through the inlet, and the washing water treatment apparatus includes a second filter to filter water passing through the first filter. The filter blade may include a blade provided to correspond to the second filter.

The case may include a filter guide formed to protrude from an inner surface of the case to guide mounting of the filter. The filter guide may include an inclined shape formed to protrude more in an inner direction of the case along a direction to which the filter is mounted.

The washing water treatment apparatus may include a blade support to rotatably support the filter blade, the blade support including a receiving guide formed in a portion along a circumferential direction, and a drive bracket to fix the filter driving source to the case, the drive bracket including a blade guide receivable in the receiving guide in response to mounting the filter to the case.

The washing water treatment apparatus may include a drive shaft configured to transmit power from the filter driving source to the drive gear, and a driving seal provided to seal an area between the drive shaft and the drive bracket.

The first rotation axis and the second rotation axis may be perpendicular to each other.

The drive gear and the filter gear may be provided as a bevel gear.

In accordance with another aspect of the disclosure, a clothes treating apparatus includes a cabinet, a tub arranged inside the cabinet, and a washing water treatment apparatus connected to tub. The washing water treatment apparatus includes a case in which an inlet is formed, a circulation pump mounted to the case to be in a position adjacent to the inlet, a drain pump mounted to the case to be in a position further away from the inlet than the circulation pump, a filter detachably mounted inside the case between the circulation pump and the drain pump, a filter driving source arranged adjacent to the drain pump, and a filter blade rotatably provided inside the filter by receiving power from the filter driving source.

The washing water treatment apparatus may include a drive gear configured to be rotated along a first rotation axis by receiving power from the filter driving source, and a filter gear configured to be rotated along a second rotation axis perpendicular to the first rotation axis, the filter gear configured to rotate the filter blade according to a rotation of the drive gear.

The circulation pump may include a circulation motor configured to generate a water flow for circulating washing water to the tub, the circulation motor including a rotation axis perpendicular to a rotation axis of the filter driving source. The drain pump may include a drain pump configured to generate a water flow for discharging washing water to an outside of the cabinet, the drain pump including a rotation axis perpendicular to the rotation axis of the filter driving source and the rotation axis of the circulation motor.

The case may include a circulation opening arranged adjacent to the circulation pump to guide washing water that is circulated to the tub by the circulation pump, and a drain opening arranged adjacent to the drain pump to guide washing water that is discharged to the outside of the cabinet by the drain pump. The filter driving source may be arranged adjacent to the drain opening.

The washing water treatment apparatus may be arranged below the tub.

BRIEF DESCRIPTION OF THE DRAWINGS

The above and other aspects, features, and advantages of certain embodiments of the present disclosure will be more apparent from the following description taken in conjunction with the accompanying drawings of which.

DETAILED DESCRIPTION

Figure 1:
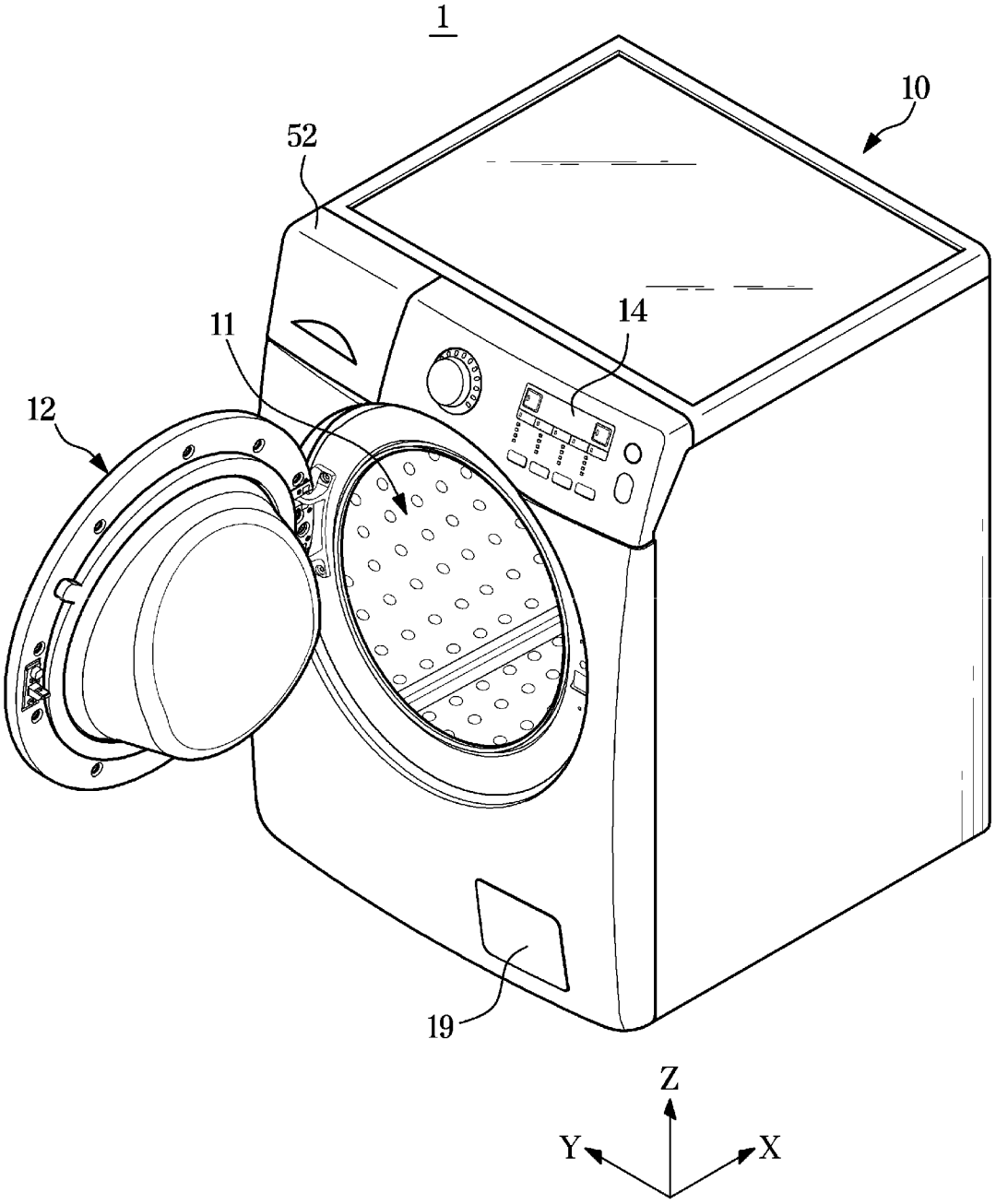
FIG. 1 illustrates a washing machine according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The disclosure will be described more fully hereinafter with reference to the accompanying drawings.

Therefore, it is an aspect of the disclosure to provide a washing machine and a clothes treating apparatus capable of preventing dogging of a filter.

It is another aspect of the disclosure to provide a washing machine and a clothes treating apparatus capable of easily managing a filter.

Figure 2:
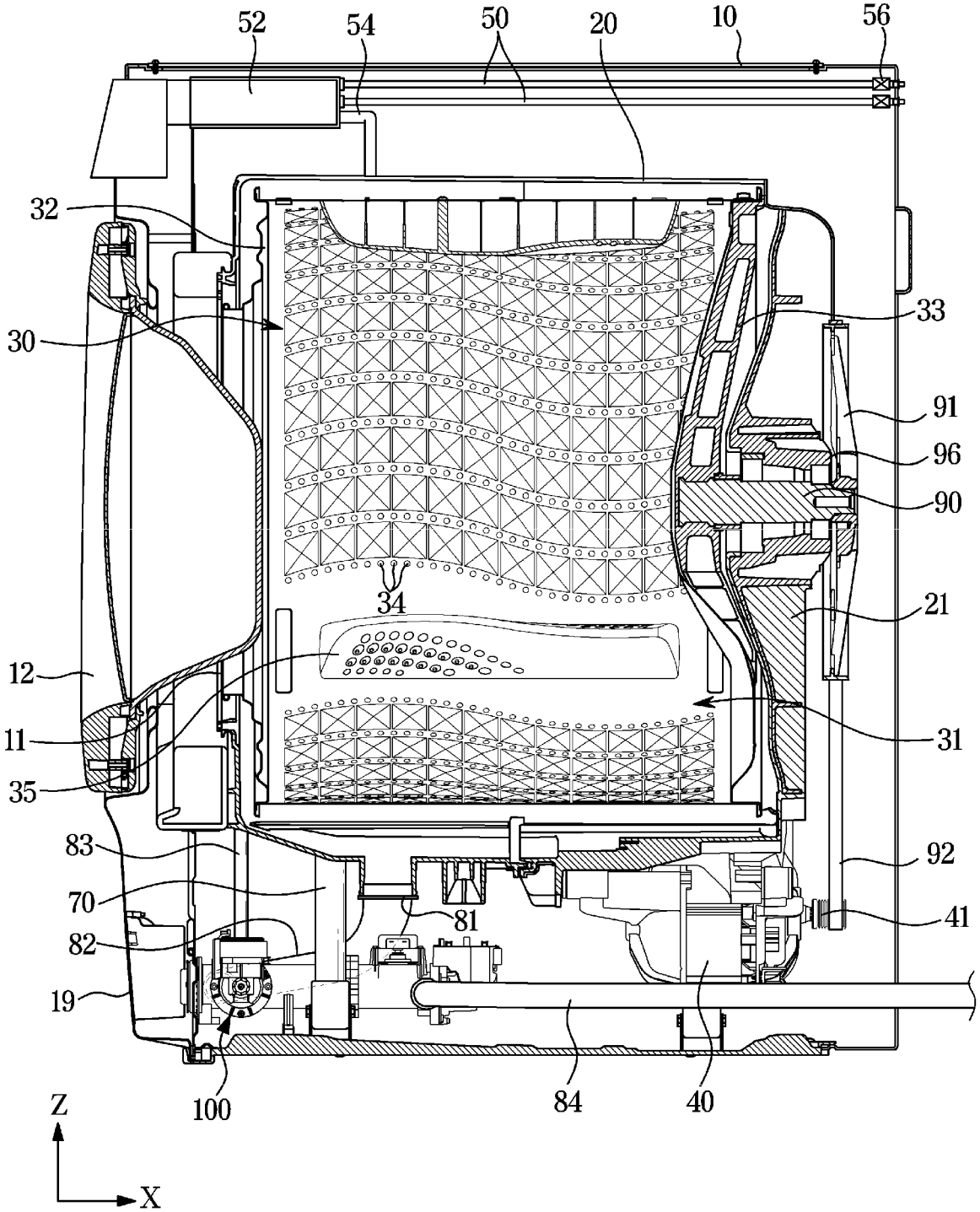
FIG. 2 illustrates a cross-section of the washing machine shown in FIG. 1.

Additional aspects of the disclosure will be set forth in part in the description which follows and, in part, will be obvious from the description, or may be learned by practice of the disclosure. FIG. 1 illustrates a washing machine according to an embodiment of the disclosure. FIG. 2 illustrates a cross-section of the washing machine shown in FIG. 1.

Referring to FIGS. 1 and 2, a washing machine 1 may include a cabinet 10 forming an exterior of the washing machine 1, a tub 20 arranged inside the cabinet 10, a drum 30 rotatably arranged inside the tub 20, and a drive motor 40 configured to drive the drum 30.

An inlet port 11 may be formed in a front portion of the cabinet 10 to put laundry into the drum 30. The inlet port 11 may be opened and closed by a door 12 installed on the front portion of the cabinet 10.

A water supply pipe 50 provided to supply washing water to the tub 20 may be provided above the tub 20. One side of the water supply pipe 50 may be connected to a water supply valve 56, and the other side of the water supply pipe 50 may be connected to a detergent box 52.

The detergent box 52 may be connected to the tub 20 through a connection pipe 54. Water supplied through the water supply pipe 50 may be supplied into the tub 20 together with the detergent via the detergent box 52.

The tub 20 may be supported by a damper 70. The damper 70 may connect an inner bottom surface of the cabinet 10 to an outer surface of the tub 20.

The drum 30 may include a cylindrical member 31, a front plate 32 arranged in front of the cylindrical member 31, and a rear plate 33 arranged at rear of the cylindrical member 31. An opening for inserting and withdrawing laundry may be formed in the front plate 32. A shaft 90 provided to transmit power of the drive motor may be connected to the rear plate 33.

A plurality of through-holes 34 may be formed around the drum 30 for distribution of washing water, and a plurality of lifters 35 may be installed on an inner circumferential surface of the drum 30 to allow the laundry to rise and fall in response to rotation of the drum 30.

The drum 30 and the drive motor 40 are connected through the shaft 90, and according to a connection method between the shaft 90 and the drive motor 40, the washing machine 1 may be classified into a direct drive type in which the shaft 90 is directly connected to the drive motor 40 so as to rotate the drum 30, and an indirect drive type in which a pulley 91 is connected to between the shaft 90 and the drive motor 40 so as to drive the drum 30.

The washing machine 1 according to an embodiment of the disclosure may be provided as the indirect drive type, but is not limited thereto. Therefore, technical features of the disclosure are applicable to the direct drive type.

One end of the shaft 90 is connected to the rear plate 33 of the drum 30, and the other end of the shaft 90 extends to the outside of a rear member 21 of the tub 20. The other end of the shaft 90 may be provided to be inserted into the pulley 91 in order to obtain a driving force from the drive motor 40. In addition, a motor pulley 41 is formed on a rotating shaft of the drive motor 40. A drive belt 92 is provided between the motor pulley 41 and the shaft pulley 91 and thus the shaft 90 may be driven by the drive belt 92.

The drive motor 40 may be arranged on one side of a lower portion of the tub and thus the drive motor 40 may drive the shaft 90 while the drive belt 92 is rotated clockwise or counterclockwise with respect to a vertical direction of the tub 20.

A bearing housing 96 is installed on the rear member 21 of the tub 20 to rotatably support the shaft 90. The bearing housing 96 may be formed of an aluminum alloy, and may be inserted into the rear member 21 of the tub 20 in a process in which the tub 20 is injection molded.

Further, a display 14 provided to display a state of the washing machine 1 to a user may be provided on a front upper portion of the cabinet 10. The display 14 may include an inputter. A printed circuit board assembly (not shown) may be provided on the front upper portion of the cabinet 10.

A cover 19 provided to cover a washing water treatment apparatus 100 may be provided at a lower front of the cabinet 10. As a user opens the cover 19, the user can access the washing water treatment apparatus 100.

Figure 3:
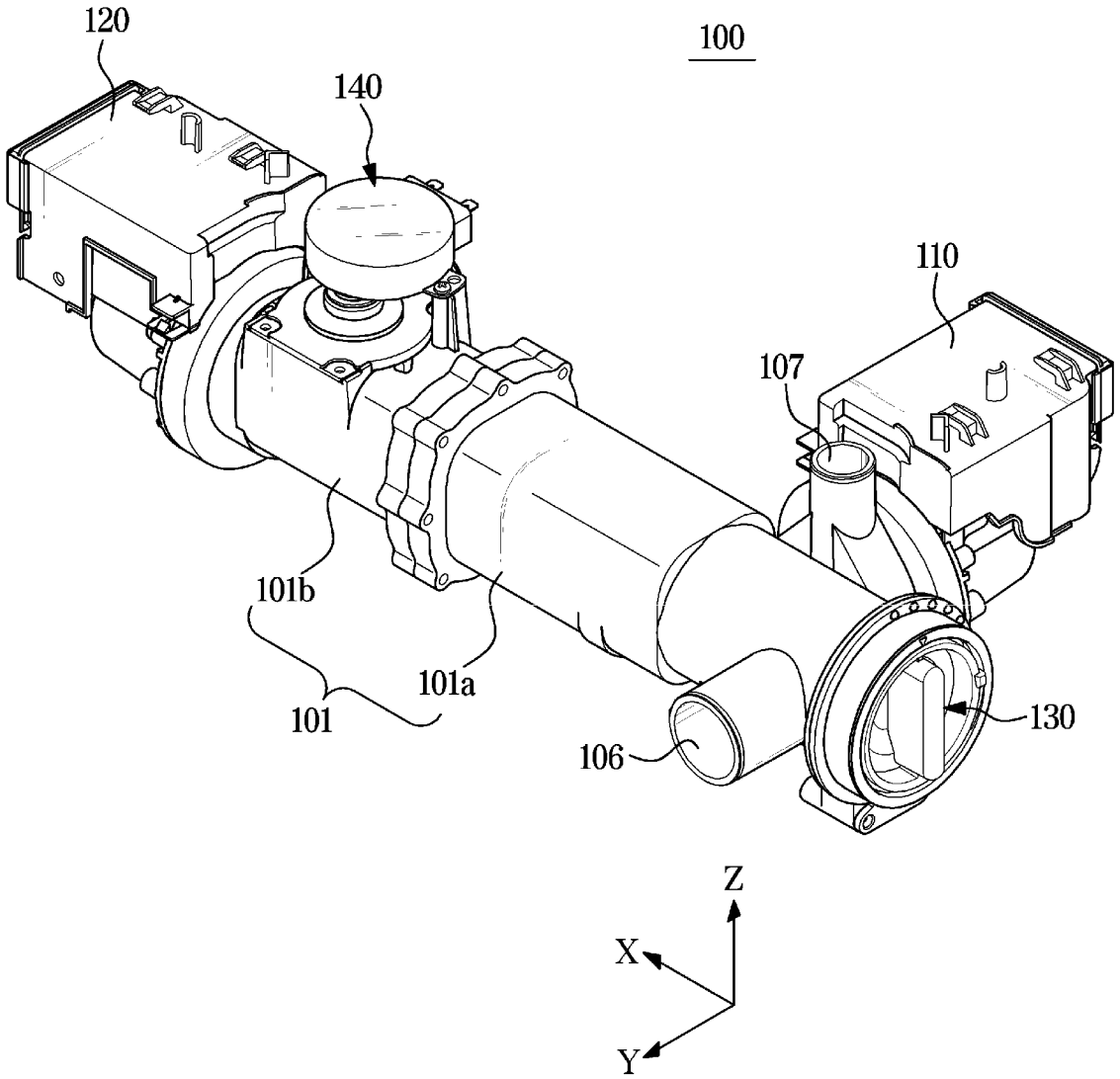
FIG. 3 illustrates a washing water treatment apparatus shown in FIG. 2.
Figure 4:
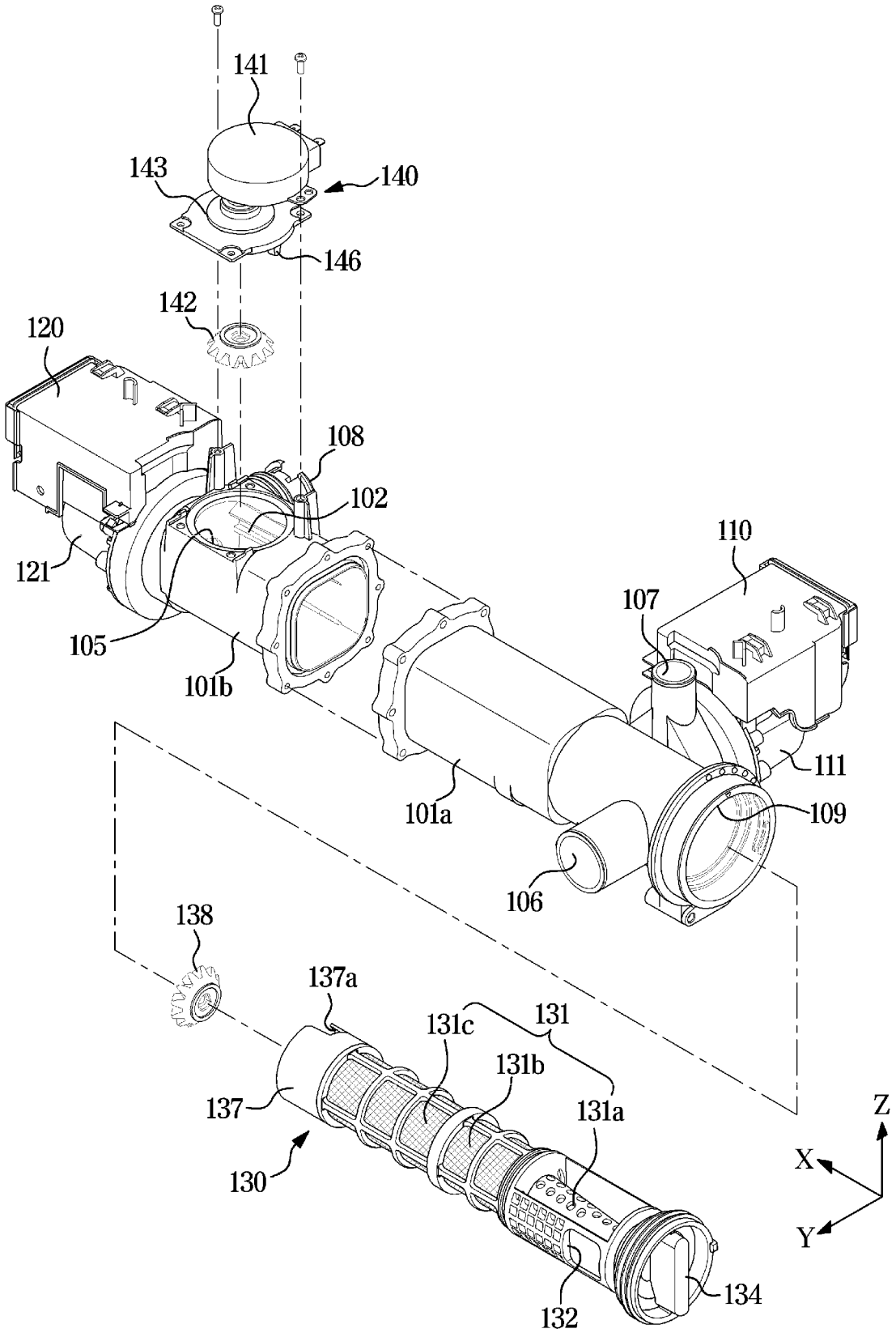
FIG. 4 illustrates an exploded-view of the washing water treatment apparatus shown in FIG. 3.
Figure 5:
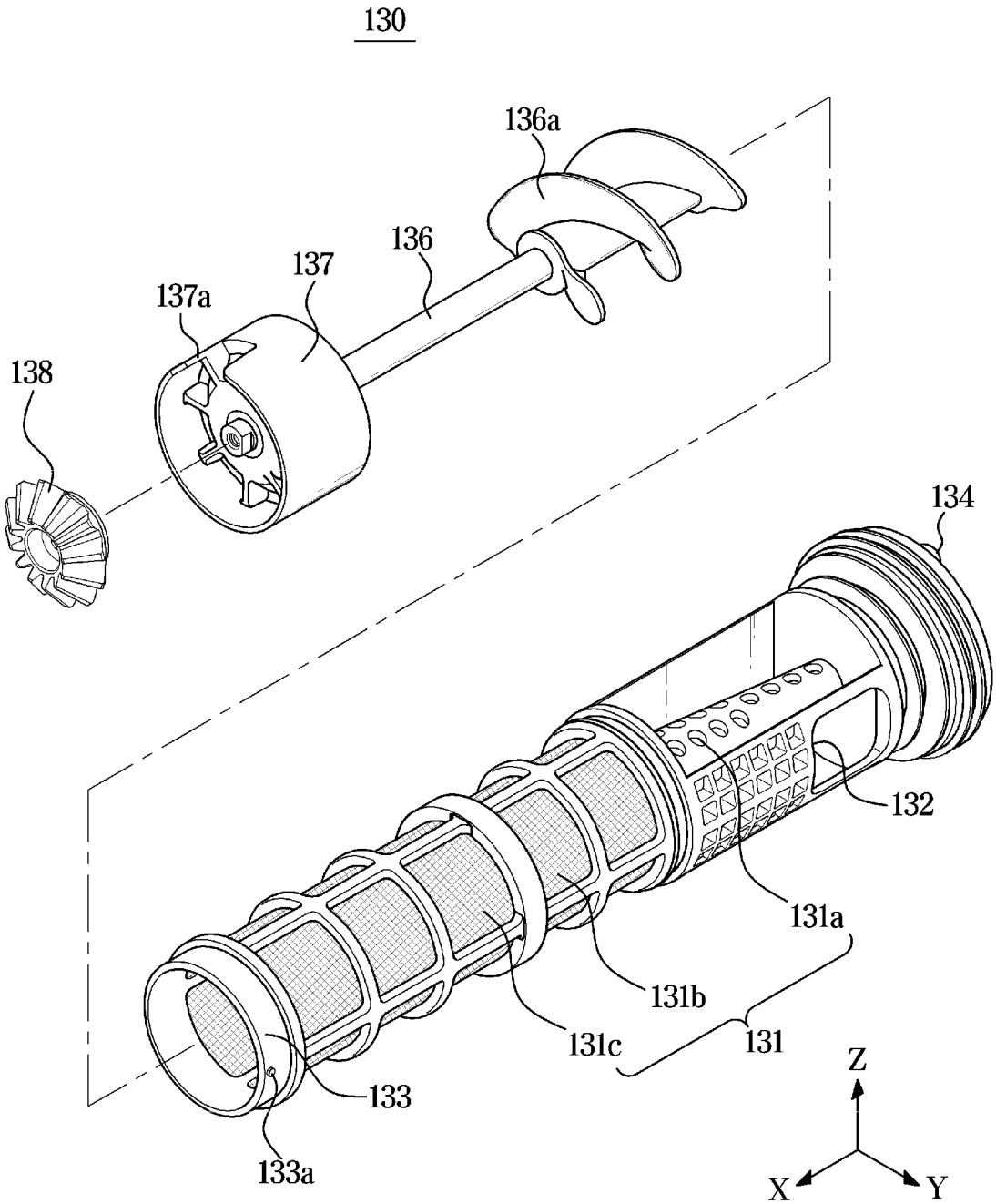
FIG. 5 illustrates an exploded-view of a filter device shown in FIG. 4.
Figure 6:
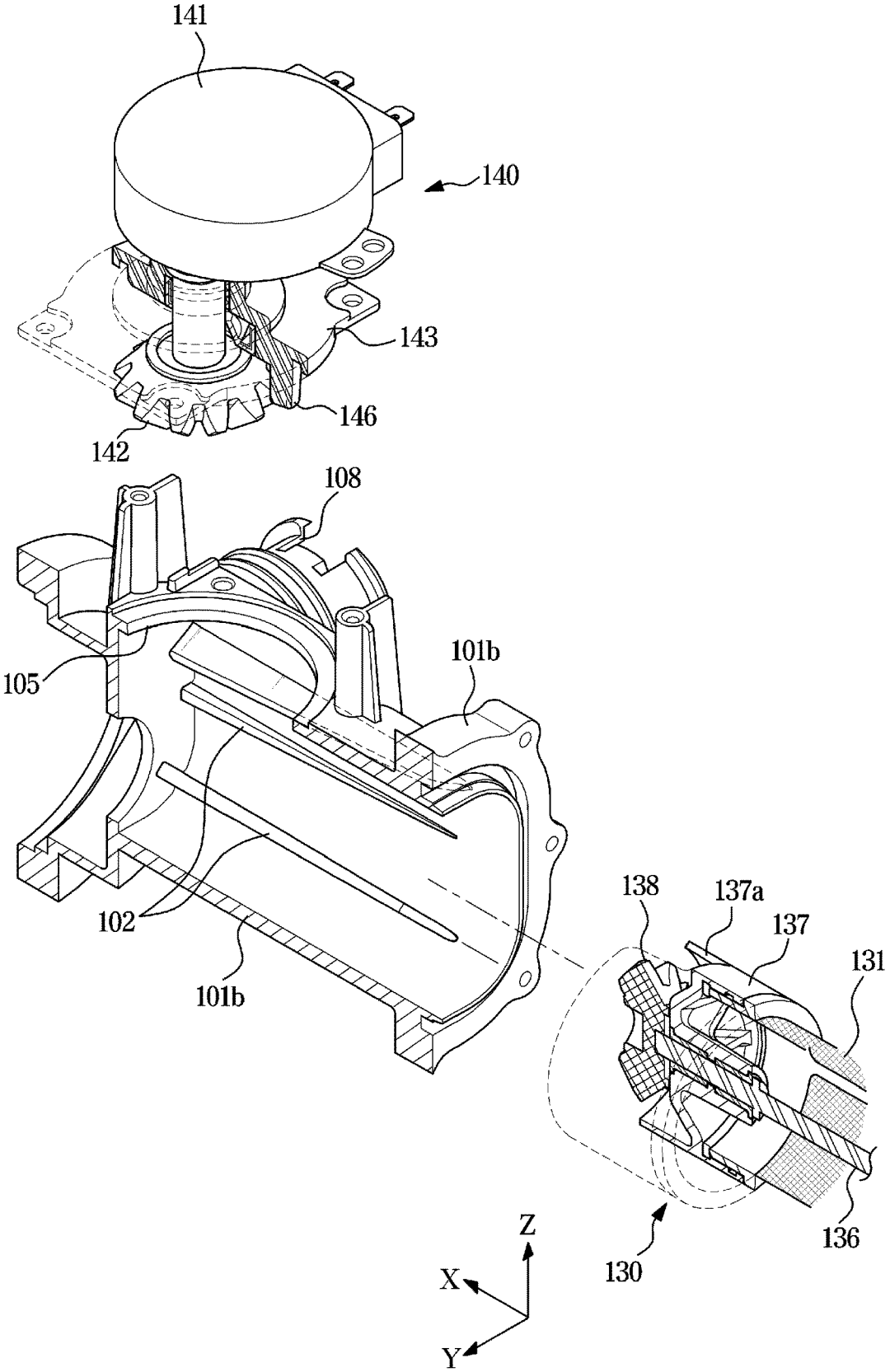
FIG. 6 illustrates an inside of a second case to which the filter device and a filter drive device shown in FIG. 4 are mounted.
Figure 7:
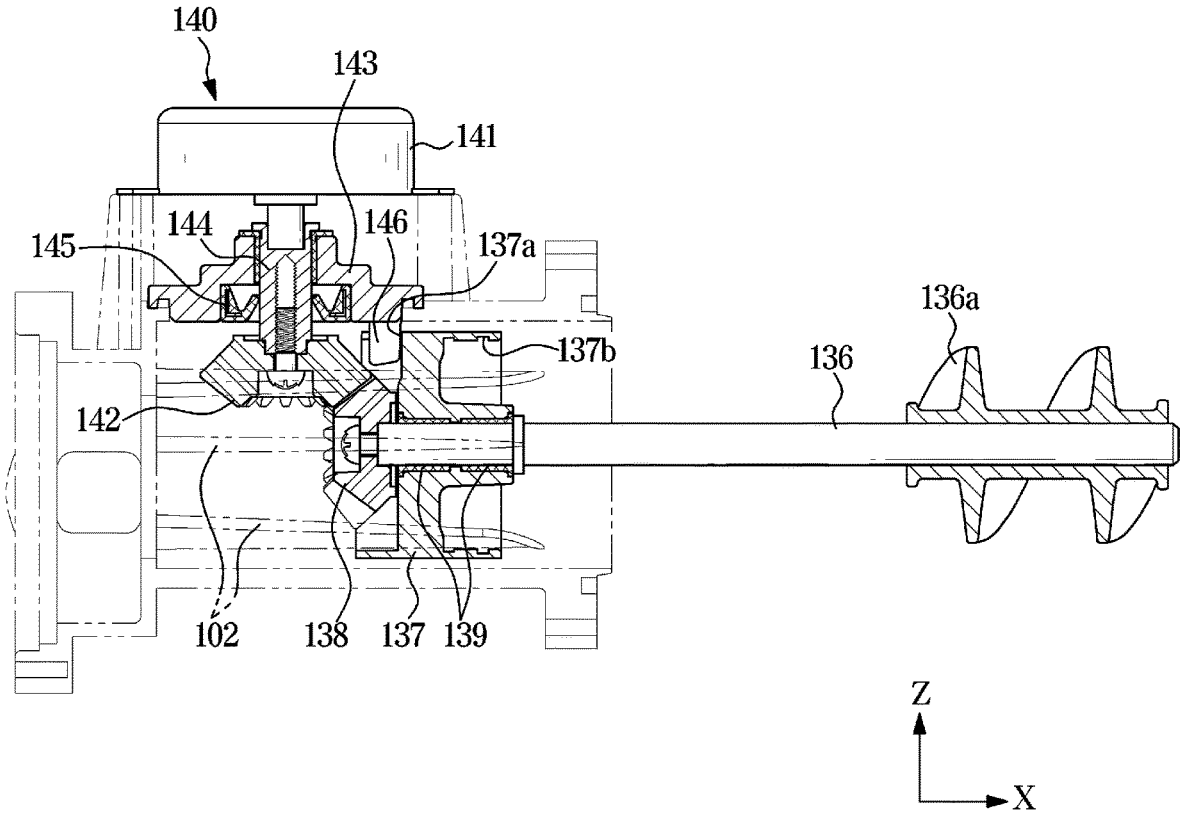
FIG. 7 illustrates a state in which the filter device and the filter drive device shown in FIG. 4 are engaged with each other.

FIG. 3 illustrates a washing water treatment apparatus shown in FIG. 2. FIG. 4 illustrates an exploded-view of the washing water treatment apparatus shown in FIG. 3. FIG. 5 illustrates an exploded-view of a filter device shown in FIG. 4. FIG. 6 illustrates an inside of a second case to which the filter device and a filter drive device shown in FIG. 4 are mounted. FIG. 7 illustrates a state in which the filter device and the filter drive device shown in FIG. 4 are engaged with each other.

Referring to FIGS. 3 and 4, the washing water treatment apparatus 100 may be arranged under the tub 20. The washing water treatment apparatus 100 may be configured to circulate the washing water of the tub 20 or to discharge the washing water from the tub 20 to an outside of the washing machine 1. The washing water treatment apparatus 100 may be connected to the tub 20.

In order to allow the washing water of the tub 20 to flow into the washing water treatment apparatus 100, the washing water treatment apparatus 100 may be connected to the tub 20 through a drain port 81 and a connection hose 82. In order to circulate water, which flows into the washing water treatment apparatus 100, to the tub 20, the washing water treatment apparatus 100 may be connected to the tub 20 through a circulation hose 83. In order to discharge the water, which flows into the washing water treatment apparatus 100, to an outside of the washing machine 1, the washing water treatment apparatus 100 may be connected to a drain hose 84.

The washing water treatment apparatus 100 may include a case 101. The case 101 may form an exterior of the washing water treatment apparatus 100. The case 101 may extend in an X-axis direction. The case 101 may be provided to receive a filter device 130. A circulation pump 110 may be mounted on the case 101. A drain pump 120 may be mounted on the case 101. A filter drive device 140 may be mounted on the case 101. The case 101 may include a first case 101*a* and a second case 101*b* detachably coupled to the first case 101*a*.

The circulation pump 110 may be mounted on the first case 101*a*. An inlet 106 connected to the connection hose 82 may be formed in the first case 101*a*. Washing water of the tub 20 may flow into the washing water treatment apparatus 100 through the inlet 106. A circulation opening 107 connected to the circulation hose 83 may be formed in the first case 101*a*. The circulation opening 107 may be arranged adjacent to the circulation pump 110 to guide the washing water that is circulated to the tub 20 by the circulation pump 110. A filter insertion port 109 may be formed in the first case 101*a* to allow the filter device 130 to be inserted thereinto.

The drain pump 120 and the filter drive device 140 may be mounted on the second case 101*b*. A drain opening 108 connected to the drain hose 84 may be formed in the second case 101*b*. The drain opening 108 may be arranged adjacent to the drain pump 120 to guide washing water that is discharged to the outside of the cabinet 10 by the drain pump 120. A drive device insertion port 105 may be formed in the second case 101*b* to allow a portion of the filter drive device 140 to be inserted thereinto.

The inlet 106 may be provided to be substantially perpendicular to the circulation opening 107. The inlet 106 may extend in a Y-axis direction. The circulation opening 107 may extend in a Z-axis direction. The inlet 106 and the circulation opening 107 may be formed at one end of the case 101 in which the circulation pump 110 is located. The inlet 106 and/or the circulation opening 107 may be arranged adjacent the circulation pump 110.

The drain opening 108 may be provided to be substantially perpendicular to a direction in which the case 101 extends. The drain opening 108 may extend in the Y-axis direction. The drain opening 108 may be formed at the other end opposite to one end of the case 101 in which the drain pump 120 is located. The drain opening 108 may be arranged adjacent the drain pump 120.

The washing water treatment apparatus 100 may include the circulation pump 110 configured to circulate the washing water of the tub 20. The circulation pump 110 may be mounted on the case 101. The circulation pump 110 may be mounted on the first case 101*a*. The circulation pump 110 may be arranged at one end of the case 101 in which the inlet 106 is formed. The circulation pump 110 may be arranged adjacent to the inlet 106. The circulation pump 110 may be arranged to face the inlet 106. The circulation pump 110 may include a circulation motor 111 configured to generate a rotational force along the Y-axis direction. The circulation motor 111 is provided to allow washing water, which is introduced through the inlet 106, to form a water flow discharged through the circulation opening 107.

The washing water treatment apparatus 100 may include the drain pump 120 configured to discharge washing water of the tub 20 to the outside of the washing machine 1. The drain pump 120 may be mounted on the case 101. The drain pump 120 may be mounted on the second case 101*b*. The drain pump 120 may be arranged at the other end opposite to one end of the case 101 in which the inlet 106 is formed. The drain pump 120 may be arranged further away from the inlet 106 than the circulation pump 110. The drain pump 120 may include a drain motor 121 configured to generate a rotational force along the X-axis direction. The drain motor 121 is provided to allow washing water, which is introduced through the inlet 106, to form a water flow discharged through the drain opening 108.

A rotation axis (parallel to the Y-axis direction) of the circulation motor 111 may be provided to be different from a rotation axis (parallel to the X-axis direction) of the drain motor 121. The rotation axis of the circulation motor 111 may be provided to be perpendicular to a rotation axis of the drain motor 121.

Referring to FIGS. 4 and 5, the washing water treatment apparatus 100 may include the filter device 130 provided to filter the water discharged through the drain pump 120. The filter device 130 may extend along the X-axis direction. The filter device 130 may be received in the case 101. The filter device 130 may be provided to filter the washing water flowing into the washing water treatment apparatus 100.

The filter device 130 (also referred to as filter assembly 130) may include a filter 131 and a filter blade 136 rotatably provided inside the filter 131.

The filter 131 may be detachably mounted inside the case 101. The filter 131 may be arranged between the circulation pump 110 and the drain pump 120. The filter 131 may include a first filter member 131*a* (also referred to as a first filter 131*a*), a second filter member 131*b* (also referred to as a second filter 131*b*), and a third filter member 131*c* (also referred to as a third filter 131*c*). The filter 131 may include a filter opening 132 arranged to face the inlet 106 upon being mounted on the case 101. Washing water introduced through the inlet 106 may be moved into the filter 131 through the filter opening 132.

The washing water introduced into the inside of the filter 131 through the filter opening 132 may be primarily filtered by the first filter member 131*a*. The first filter member 131*a* may include a plurality of openings. In the first filter member 131*a*, a relatively large size of foreign substance may be filtered out. The washing water filtered by the first filter member 131*a* may be moved to the tub 20 by the circulation pump 110. The washing water filtered by the first filter member 131*a* may be moved to the second filter member 131*b* by the drain pump 120.

The washing water passing through the first filter member 131*a* may pass through the second filter member 131*b* and be secondarily filtered. The washing water passing through the second filter member 131*b* may pass through the third filter member 131*c* and be tertiary filtered. Foreign substances separated from the second filter member 131*b* by the filter blade 136 may be collected in the third filter member 131*c*. The second filter member 131*b* and the third filter member 131*c* may include a mesh filter. In the second filter member 131*b* and the third filter member 131*c*, a relatively small size of foreign substance may be filtered out.

The first filter member 131*a*, the second filter member 131*b*, and the third filter member 131*c* may be sequentially arranged along a direction in which washing water flows.

The filter 131 may include a blade mounting member 133 for mounting the filter blade 136. The blade mounting member 133 may be located at the other end opposite to one end of the filter 131 in which a filter handle 134 is located. A blade mounting protrusion 133*a* may be formed in the blade mounting member 133. The blade mounting protrusion 133*a* may be inserted into a blade support groove 137*b* of a blade support 137.

The filter 131 may include the filter handle 134. The filter handle 134 may be provided to be exposed to an outside of the case 101 in response to mounting the filter 131 to the case 101. A user can separate the filter 131 from the case 101 by using the filter handle 134.

The filter blade 136 may be rotatably provided inside the filter 131. The filter blade 136 may include a blade 136*a*. The blade 136*a* may be formed in a spiral shape extending radially from a rotation axis of the filter blade 136 along the rotation axis direction (for example, the X-axis direction) of the filter blade 136. The blade 136*a* may be provided to correspond to the second filter member 131*b*. As the filter blade 136 is rotated inside the filter 131, the blade 136*a* may scrape and remove foreign substances attached to an inner surface of the filter 131. The blade 136*a* may be formed by including a relatively flexible material.

The filter device 130 may include the blade support 137 provided to rotatably support the filter blade 136. The blade support 137 may be fixed to the filter 131. The blade support 137 may be mounted on the blade mounting member 133. The blade support groove 137*b* may be formed in the blade support 137. The blade mounting protrusion 133*a* may be inserted into the blade support groove 137*b*.

The blade support 137 may include a receiving guide 137*a* formed in a portion along a circumferential direction. The receiving guide 137*a* may have a groove shape. A blade guide 146 provided on a drive bracket 143 may be received in the receiving guide 137*a*. In response to mounting the filter device 130 to the case 101 in a state in which the filter drive device 140 is mounted to the second case 101*b*, the receiving guide 137*a* may be aligned to receive the blade guide 146. In response to mounting the filter device 130 to the case 101, the receiving guide 137*a* of the filter device 130 may be guided by the blade guide 146 of the filter drive device 140, and accordingly, the filter device 130 may be mounted on a normal position in the case 101.

Referring to FIG. 6, a filter guide 102 provided to guide the mounting of the filter device 130 may be formed inside the second case 101*b* of the case 101. The filter guide 102 may protrude from an inner surface of the second case 101*b*. The filter guide 102 may be inclined so as to protrude more in an inner direction of the case 101 as the filter guide 102 moves along a direction to which the filter 130 is mounted. Accordingly, as the filter device 130 is inserted into the inside of the case 101, the filter device 130 may be guided to the normal position.

The filter device 130 may include a shaft bearing 139 to allow the filter blade 136 to be rotatably inserted into the blade support 137. By the shaft bearing 139, the filter blade 136 may be rotatably supported by the blade support 137.

The filter device 130 may include a filter gear 138 coupled to the other end opposite to one end at which the blade 136*a* of the filter blade 136 is positioned. The filter gear 138 may be fixed to the filter blade 136. The filter gear 138 may be provided to engage with a drive gear 142. The filter gear 138 may be provided to include a rotation axis along the X-axis direction. The rotation axis of the filter gear 138 may be provided to be the same as the rotation axis of the drain motor 121. The filter gear 138 may be provided as a bevel gear.

The washing water treatment apparatus 100 may include the filter drive device 140 configured to drive the filter device 130. The filter drive device 140 may be mounted on the case 101. The filter drive device 140 may be mounted on the second case 101*b*. The filter drive device 140 may include a filter driving source 141, the drive gear 142, the drive bracket 143, and a drive shaft 144.

The filter driving source 141 may be configured to generate power for rotating the filter blade 136. The filter driving source 141 may be provided to generate a rotational force in an axis extending along the Z-axis direction. The filter driving source 141 may be arranged at a position closer to the drain pump 120 than to the circulation pump 110. The filter drive source 141 may be arranged adjacent to the drain opening 108. As the filter driving source 141 is arranged adjacent to the drain opening 108 and configured to generate a rotational force about the Z-axis direction, the washing water discharged through the drain opening 108 may be converted to a minimum water flow and then discharged.

The drive gear 142 may be configured to be rotated along the Z-axis direction by receiving the rotational force from the filter driving source 141. The rotation axis (parallel to the Z-axis direction) of the drive gear 142 may be provided to be different from the rotation axis (parallel to the X-axis direction) of the drain motor 121. The drive gear 142 may be provided as a bevel gear.

Referring to FIG. 7, the rotation axis of the filter gear 138 coupled to the filter blade 136 may extend along the X-axis direction, and the rotation axis of the drive gear 142 of the filter drive device 140 may extend along the Z-axis direction. The rotation axis of the filter gear 138 may be provided to form a predetermined angle with the rotation axis of the drive gear 142. The rotation axis of the filter gear 138 may be perpendicular to the rotation axis of the drive gear 142.

A rotational force of the filter driving source 141 may be transmitted to the drive gear 142 through the drive shaft 144. The drive shaft 144 may be rotatably inserted into the drive bracket 143. The drive bracket 143 may rotatably support the drive shaft 144. The drive bracket 143 may be fixed to the case 101. The drive bracket 143 may be provided with the blade guide 146.

The filter drive device 140 may include a driving sealing member 145 (also referred to as a driving seal) provided to seal a portion of the drive bracket 143 on which the drive shaft 144 is mounted. The driving sealing member 145 may seal between the drive shaft 144 and the drive bracket 143. The driving sealing member 145 may include oil. The driving sealing member 145 may rotatably support the drive shaft 144.

Figure 8:
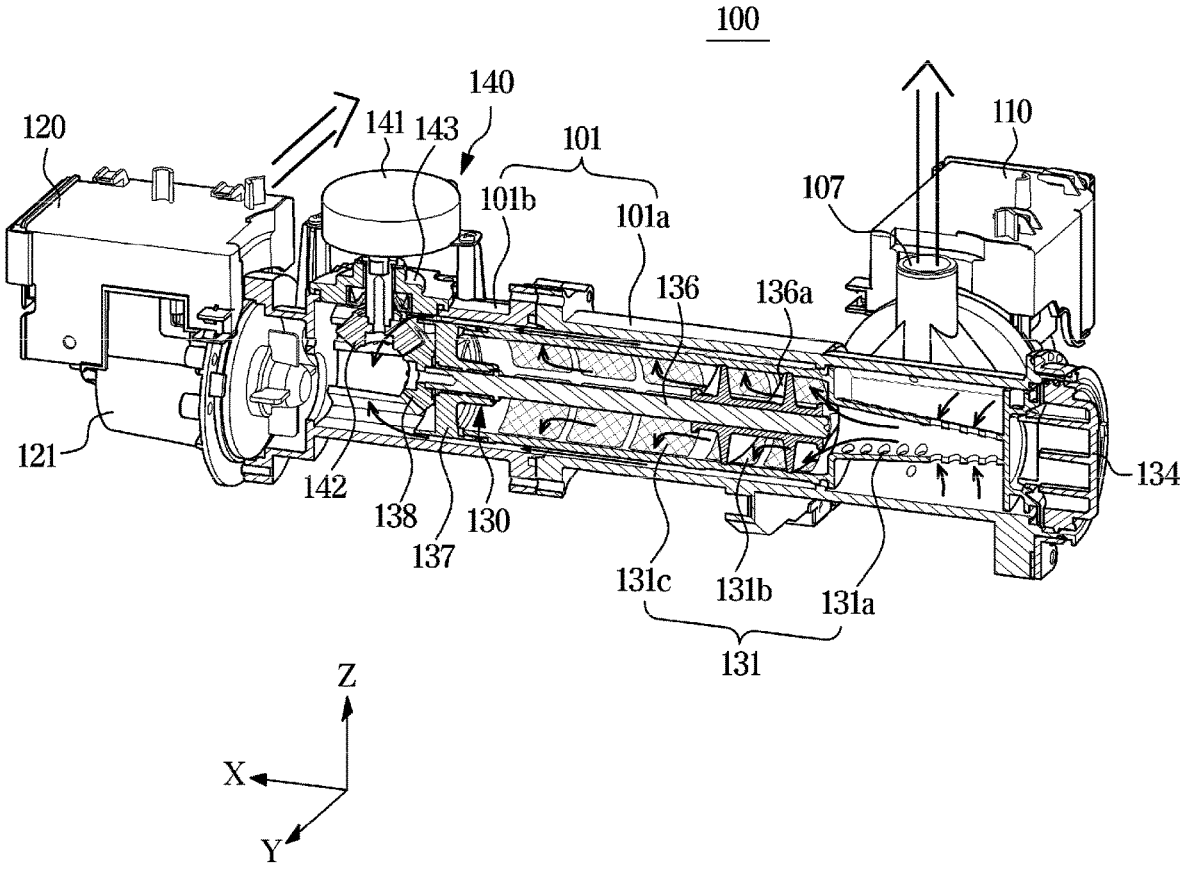
FIG. 8 illustrates a flow of washing water passing through the washing water treatment apparatus 100 shown in FIG. 3.

FIG. 8 illustrates a flow of washing water passing through the washing water treatment apparatus 100 shown in FIG. 3.

In a state in which the circulation pump 110 is operated, the washing water flowing into the washing water treatment apparatus 100 through the inlet 106 may be discharged to the outside of the washing water treatment apparatus 100 through the circulation opening 107.

Referring to FIG. 8, in a state in which the drain pump 120 is operated, the washing water flowing into the washing water treatment apparatus 100 through the inlet 106 may be primarily filtered by the first filter member 131*a*.

The washing water primarily filtered by the first filter member 131*a* may be moved to the second filter member 131*b*. The washing water being secondarily filtered by passing through the second filter member 131*b* may pass through the third filter member 131*c*. Washing water that is not filtered while passing through the second filter member 131*b* may be filtered by the third filter member 131*c*. The washing water passing through the filter 131 may be discharged to the outside of the washing water treatment apparatus 100 through the drain opening 108.

Figure 9:
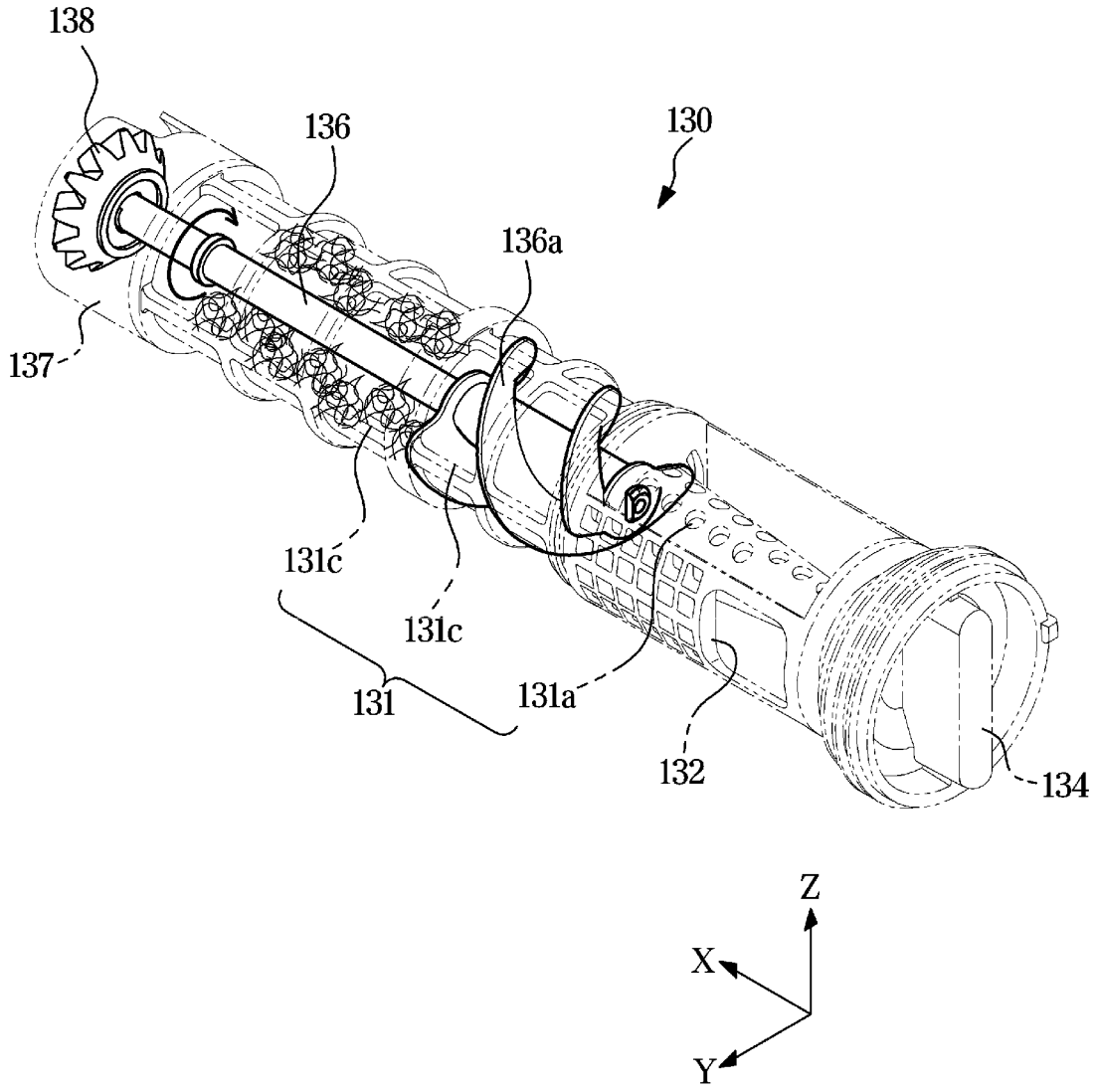
FIG. 9 illustrates a state in which foreign substances are collected inside the filter device shown in FIG. 4.
Figure 10:
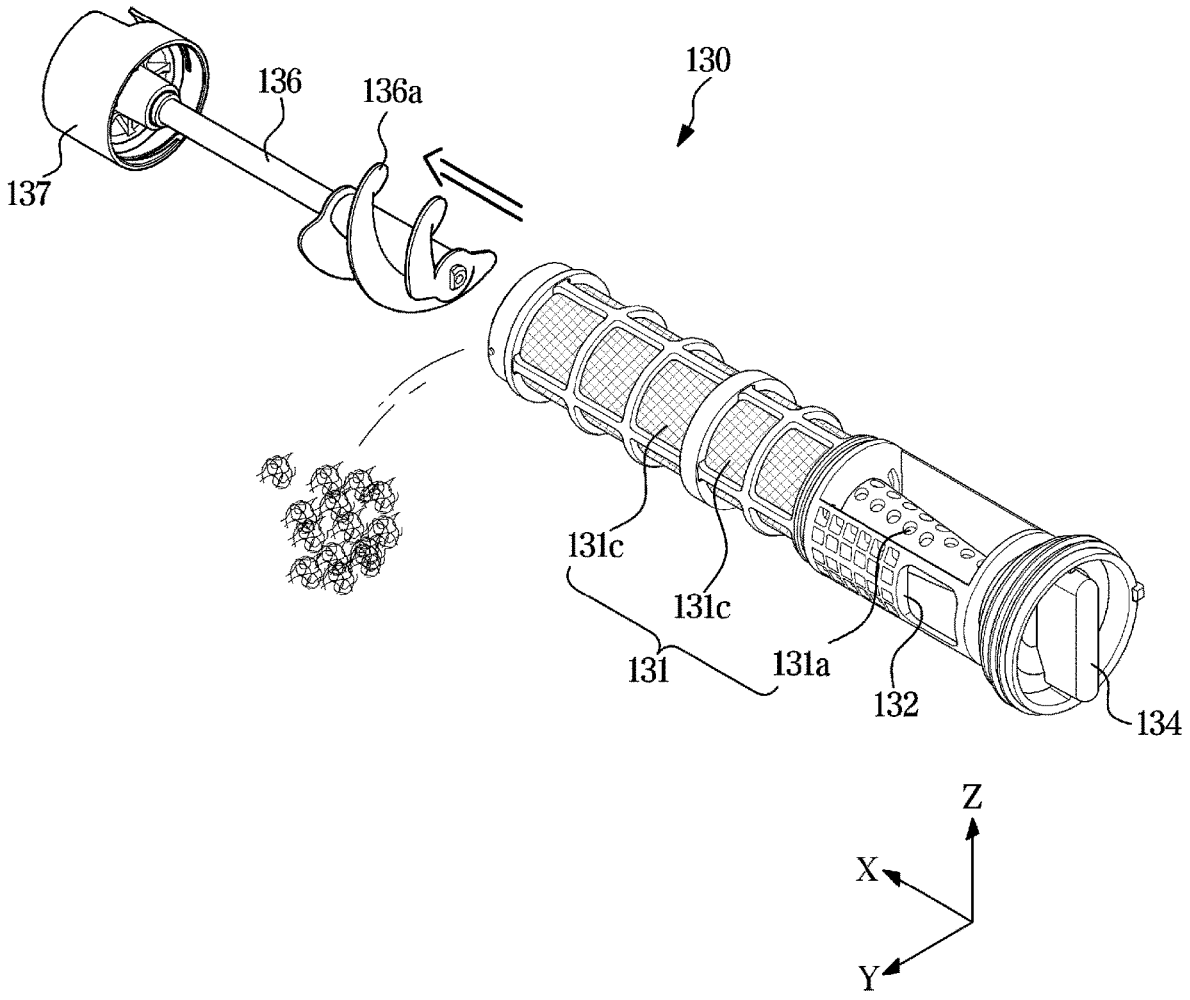
FIG. 10 illustrates a state in which foreign substances inside the filter device shown in FIG. 9 are removed.

FIG. 9 illustrates a state in which foreign substances are collected inside the filter device shown in FIG. 4. FIG. 10 illustrates a state in which foreign substances inside the filter device shown in FIG. 9 are removed.

Referring to FIG. 9, while the drain pump 120 is operated, the filter drive device 140 may be operated. As the filter drive device 140 is operated, the filter blade 136 may be rotated. As the filter blade 136 is rotated, the blade 136*a* comes into contact with the inner surface of the second filter member 131*b* and scratches the inner surface of the second filter member 131*b*. Accordingly, it is possible to prevent foreign substances from accumulating on the inner surface of the second filter member 131*b*. The blade 136*a* may move the foreign substance on the inner surface of the second filter member 131*b* toward the side of the third filter member 131*c*. Accordingly, the foreign substances may be collected on the side of the third filter member 131*c*.

Referring to FIG. 10, as the filter blade 136 is separated from the filter 131, it is possible to remove the foreign substances stored in the third filter member 131*c*. Particularly, referring to FIG. 1, as the cover 19 is opened, a user can access the filter handle 134. The user can separate the filter device 130 from the case 101 by gripping the filter handle 134. The user can separate the filter blade 136 from the filter 131 to remove the foreign substances present in the third filter member 131*c*.

Figure 11:
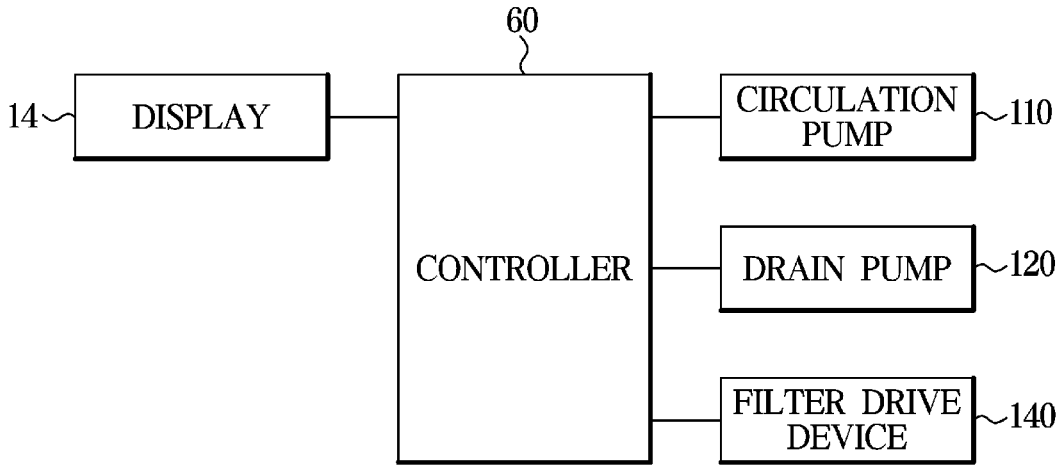
FIG. 11 illustrates a control block diagram of the washing machine shown in FIG. 1.

FIG. 11 illustrates a control block diagram of the washing machine shown in FIG. 1.

Referring to FIG. 11, the washing machine 1 may include a controller 60. The controller 60 may be electrically connected to the display 14. In response to a command inputted through the display 14, the controller 60 may receive the users command from the display 14.

The controller 60 may be electrically connected to the circulation pump 110. The controller 60 may be electrically connected to the drain pump 120. The controller 60 may be electrically connected to the filter drive device 140.

The controller 60 may control the circulation pump 110 based on the information received from the display 14. The controller 60 may control the drain pump 120 based on the information received from the display 14. The controller 60 may control the filter drive device 140 based on the information received from the display 14.

Figure 12:
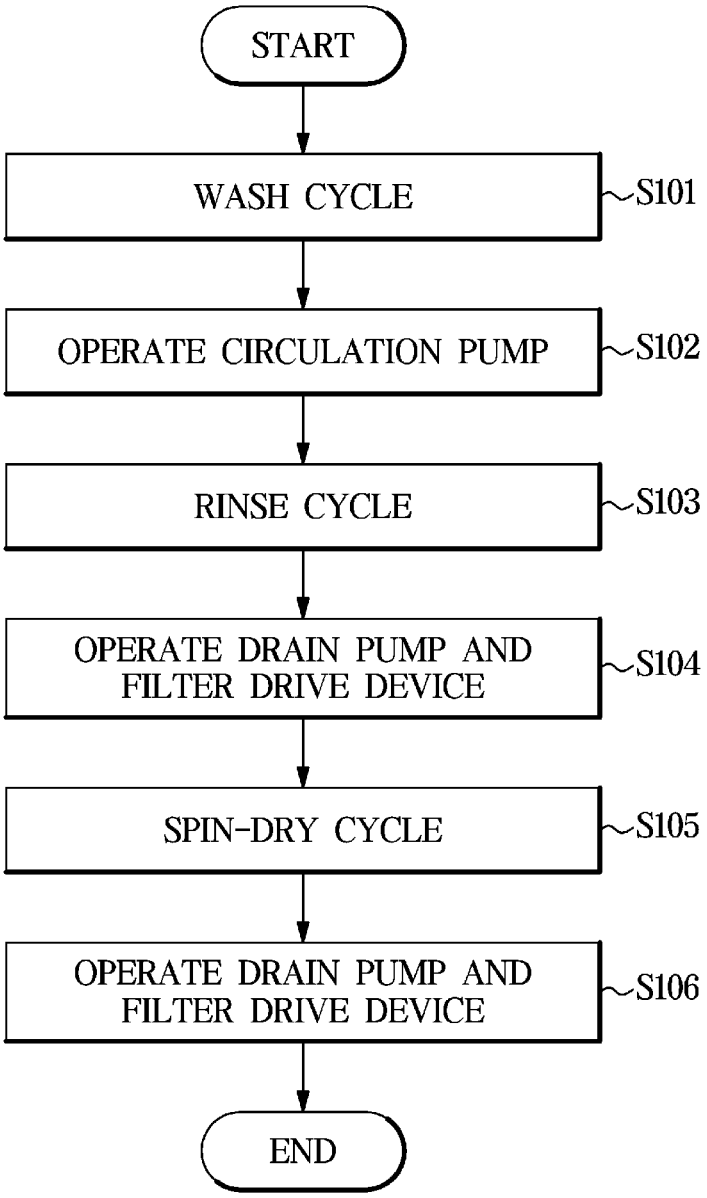
FIG. 12 illustrates a flowchart of the washing machine shown in FIG. 1.

FIG. 12 illustrates a flowchart of the washing machine shown in FIG. 1.

Referring to FIG. 12, the washing machine 1 may perform awash cycle (101). As the washing machine 1 performs the wash cycle, the circulation pump 110 may be operated (102). The washing water of the tub 20 may be circulated by the circulation pump 110.

The washing machine 1 may perform a rinse cycle after performing the wash cycle (103). As the washing machine 1 performs the rinse cycle, the drain pump 120 and the filter drive device 140 may be operated (104). Accordingly, in response to the washing water, which is discharged to the outside of the washing machine 1, being filtered by passing through the filter 131, the filter blade 136 is rotated inside the filter 131. Accordingly, it is possible to prevent the filter 131 from being clogged by foreign substances.

The washing machine 1 may perform a spin-dry cycle after performing the rinse cycle (105). As the washing machine 1 performs the spin-dry cycle, the drain pump 120 and the filter drive device 140 may be operated (106). Accordingly, in response to the washing water, which is discharged to the outside of the washing machine 1, being filtered by passing through the filter 131, the filter blade 136 is rotated inside the filter 131. Accordingly, it is possible to prevent the filter 131 from being dogged by foreign substances.

As is apparent from the above description, a washing machine and a clothes treating apparatus may prevent clogging of a filter by including a filter blade.

Further, a washing machine and a clothes treating apparatus may easily manage a filter because a filter blade is provided to be detachably mounted to the filter.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:
a cabinet;
a tub arranged inside the cabinet; and
a washing water treatment apparatus connectable to the tub and configured to circulate water introduced in the tub and discharge the water to an outside of the cabinet,
wherein the washing water treatment apparatus includes:
a case forming an exterior of the washing water treatment apparatus,
a filter mountable on an inside of the case and detachable from the inside of the case, the filter including:
a first filter configured to filter out of the water a foreign substance having a first size, and
a second filter configured to filter out of the water a foreign substance having a second size that is smaller than the first size, wherein
with the washing water treatment apparatus connected to the tub,
the first filter is in a first flow path along which water is moved through the first filter and to the tub without moving through the second filter by a circulation pump, and
the second filter is in a second flow path along which water is moved sequentially through the first filter and the second filter and is discharged to the outside of the cabinet by a drain pump,
a filter blade rotatable inside the filter, the filter blade including a blade configured to scrape and remove the foreign substance having the second size from a surface of the second filter,
a filter driving source to generate power to rotate the filter blade,
a drive gear configured to receive the power from the filter driving source and rotate along a first rotation axis, and
a filter gear configured to rotate along a second rotation axis at a predetermined angle with respect to the first rotation axis and rotate the filter blade according to a rotation of the drive gear.

2. The washing machine of claim 1, wherein
the case includes an inlet,
the washing water treatment apparatus includes:
a circulation pump, and
a drain pump and
the case, the circulation pump, and the drain pump are configured so that, with the washing water treatment apparatus connected to the tub,
water from the tub is introduced to the case through the inlet,
the circulation pump circulates the water introduced through the inlet through the first filter and to the tub, and
the drain pump discharges the water introduced through the inlet through the first filter, through the second filter, and to the outside of the cabinet.

3. The washing machine of claim 2, wherein
a rotation axis of a drain motor of the drain pump is different from a rotation axis of a circulation motor of the circulation pump.

4. The washing machine of claim 3, wherein
a rotation axis of the drive gear is different from the rotation axis of the drain motor.

5. The washing machine of claim 3, wherein
the second rotation axis is coaxial with the rotation axis of the drain motor.

6. The washing machine of claim 2, wherein
the filter is arranged between the circulation pump and the drain pump.

7. The washing machine of claim 2, wherein
the filter driving source is arranged at a position closer to the drain pump than to the circulation pump.

8. The washing machine of claim 2, wherein
the case includes:
a circulation opening adjacent to the circulation pump, and
a drain opening adjacent to the drain pump, and
the circulation opening and the drain opening are configured so that, with the washing water treatment apparatus connected to the tub,
the circulation opening guides, to the tub, the water that is circulated to the tub by the circulation pump,
the drain opening guides the water that is discharged to the outside of the cabinet by the drain pump.

9. The washing machine of claim 8, wherein
the filter driving source is arranged adjacent to the drain opening.

10. The washing machine of claim 2, wherein
the first filter is configured to filter the water introduced through the inlet, and
the second filter is configured to filter water passing through the first filter.

11. The washing machine of claim 1, wherein
the case includes a filter guide that protrudes from an inner surface of the case to guide mounting of the filter, and
the filter guide includes an inclined shape that is inclined along an inner direction of the case in a direction in which the filter is mounted.

12. The washing machine of claim 1, wherein
the washing water treatment apparatus includes:
a blade support to rotatably support the filter blade, the blade support comprising a receiving guide formed in a portion along a circumferential direction; and
a drive bracket to fix the filter driving source to the case, the drive bracket comprising a blade guide receivable in the receiving guide in response to mounting the filter to the case.

13. The washing machine of claim 12, wherein
the washing water treatment apparatus comprises:
a drive shaft configured to transmit power from the filter driving source to the drive gear; and
a driving seal provided to seal an area between the drive shaft and the drive bracket.

14. The washing machine of claim 1, wherein
the first rotation axis and the second rotation axis are perpendicular to each other.

15. The washing machine of claim 1, wherein the drive gear and the filter gear are provided as a bevel gear.

16. The washing machine of claim 1, wherein the first filter includes a plurality of openings, and the second filter includes a mesh filter.

* * * * *